US007857182B2

(12) United States Patent
Kato et al.

(10) Patent No.: US 7,857,182 B2
(45) Date of Patent: Dec. 28, 2010

(54) STAPLER

(75) Inventors: Yutaka Kato, Tokyo (JP); Tomoaki Saito, Tokyo (JP)

(73) Assignee: Max Co., Ltd., Tokyo (JP)

( * ) Notice: Subject to any disclaimer, the term of this patent is extended or adjusted under 35 U.S.C. 154(b) by 132 days.

(21) Appl. No.: 12/095,099

(22) PCT Filed: Nov. 27, 2006

(86) PCT No.: PCT/JP2006/323610

§ 371 (c)(1),
(2), (4) Date: May 27, 2008

(87) PCT Pub. No.: WO2007/061096

PCT Pub. Date: May 31, 2007

(65) Prior Publication Data

US 2008/0308595 A1 Dec. 18, 2008

(30) Foreign Application Priority Data

Nov. 28, 2005 (JP) ..... 2005-341868
Dec. 20, 2005 (JP) ..... 2005-366080

(51) Int. Cl.
*B25C 5/15* (2006.01)

(52) U.S. Cl. ..... 227/6; 227/2; 227/131

(58) Field of Classification Search ..... 227/1, 227/5–7, 131
See application file for complete search history.

(56) References Cited

U.S. PATENT DOCUMENTS 2,403,947 A * 7/1946 Oussani ..... 227/7
2,947,002 A * 8/1960 Moore ..... 227/7
2,975,424 A * 3/1961 Oussani ..... 227/7
3,276,654 A * 10/1966 Yeager et al. ..... 227/131
3,278,101 A * 10/1966 Yasuzo ..... 227/7
3,282,489 A * 11/1966 March ..... 227/7
3,346,163 A * 10/1967 Manganaro ..... 227/131
3,524,575 A * 8/1970 Hurkmans et al. ..... 227/7
3,531,036 A * 9/1970 Felson ..... 227/7
4,574,993 A * 3/1986 Yamanoi ..... 227/131
5,009,355 A * 4/1991 Akizawa et al. ..... 227/114
5,076,483 A * 12/1991 Olesen ..... 227/131
5,791,544 A * 8/1998 Fujimaki ..... 227/7
5,803,337 A * 9/1998 Fukai et al. ..... 227/7
6,068,173 A * 5/2000 Sueda ..... 227/7
6,090,030 A * 7/2000 Rogers ..... 493/363
6,547,119 B2 * 4/2003 Huang ..... 227/7
2005/0242151 A1 * 11/2005 Bargo et al. ..... 227/7

FOREIGN PATENT DOCUMENTS

JP 49-044316 4/1974
JP 52-54857 12/1977
JP 01-087878 6/1989
JP 4-128178 11/1992
JP 6-45340 11/1994
JP 7-290373 11/1995
JP 2005-138248 6/2005

* cited by examiner

*Primary Examiner*—Rinaldi I. Rada
*Assistant Examiner*—Lindsay Low
(74) *Attorney, Agent, or Firm*—Drinker Biddle & Reath LLP

(57) ABSTRACT

A stapler includes a binding table, a clinch member disposed on the binding table, a staple striking unit disposed above the binding table, and a movable stage disposed so as to be slidable with respect to the binding table. The movable stage is formed with an engaging portion, and the engaging portion positions an end portion of sheets placed on the movable stage. The sheets are inserted and bound between the clinch member and the staple striking unit.

6 Claims, 11 Drawing Sheets

STAPLER

TECHNICAL FIELD

The present invention relates to a stapler having a movable stage on which sheets are placed, in which the movable stage is slid in accordance with a binding position on the sheets upon binding the sheets.

BACKGROUND ART

There is an electric stapler having a binding position adjustment sensor with an automatic switch which is movable along a direction in which sheets are inserted or drawn out thereby adjusting a binding position, i.e., adjusting a position on the sheets to be stapled. (see, e.g., JP 7-290373 A).

In another electric stapler, an automatic switch and a manual switch are both provided (see, e.g., JP 6-45340 Y2).

Another electric stapler has a positioning member, on which an end portion of a stack of sheets is made to abut in order to determine a binding position, is provided so as to be slidable along a direction in which the stack of sheets is inserted or drawn out (see, e.g., JP 2005-138248A).

However, in the aforesaid electric staplers, a binding table for placing sheets to be bound thereon is fixed. Thus, an area of a portion of the she to be placed on the binding table changes when the binding position on the sheets is moved away from or toward a clinch groove. More specifically, when the binding position of sheets is moved away from the clinch groove such that the sheets are deeply inserted on the binding table, the area of the portion to be placed on the binding table becomes large. In contrast, when the binding position on the sheets is moved toward the clinch groove, for example when stapling a near-edge portion, the area of the portion of the sheets to be placed on the binding table becomes small. Thus, a binding state is unstable so that the bound sheets may sag or the binding position varies.

In an electric stapler having a fixed binding table and a position adjustment sensor which is movable along the direction in which the sheets are inserted or drawn out to carry out a depth adjustment of binding, there is another drawback in addition to the foregoing. That is, the binding position of a stapling changes in accordance with the inserting speed of the sheets. More specifically, although the sheets can be bound at a desired position when the sheets are slowly inserted, in a case where the sheets are quickly inserted, the sheets are excessively inserted during a period between a receipt of a detection signal of the sensor and an operation of the staple striking mechanism in response thereto, so that the binding position on the sheets deviates. In such a case, consequently, the sheets can not be bound at a desired binding position.

DISCLOSURE OF THE INVENTION

One or more embodiments of the present invention provide a stapler which can always support sheets over a certain range irrespective of a binding position on the sheets, and accurately bind the sheets without deviating from a desired position.

According to one or more embodiments of the invention, a stapler includes a binding table, a clinch member disposed on the binding table, a staple striking unit disposed above the binding table, and a movable stage disposed so as to be slidable with respect to the binding table. The movable stage is formed with an engaging portion, and the engaging portion positions an end portion of sheets placed on the movable stage. The sheets are inserted and bound between the clinch member and the staple striking unit.

According to one or more embodiments of the invention, the stapler further includes a sheet detecting sensor which detects a position of the end portion of the sheets, and the sheet detecting sensor moves interlockingly with the movable stage.

According to one or more embodiments of the invention, the movable stage is attachable and detachable with respect to the binding table.

According to one or more embodiments of the invention, the stapler further includes a sheet detecting sensor which is provided so as to be slidable with respect to the movable stage. The sheet detecting sensor detects the end portion of the sheets before the end portion of the sheets is positioned by the engaging portion, and the staple sting unit strikes out a staple based on a detection of the end portion of the sheets by the sheet detecting sensor.

According to one or more embodiments of the invention, a recess portion is formed on a rear portion of the movable stage, the engaging portion is formed on each end portion of a pair of pieces interposing the recess portion therebetween, the engaging portion has a standing surface extending perpendicular to an insertion direction of the sheets, and the sheet detecting sensor is positioned on an inner side of the recess portion and detects the end portion of the sheets before the end portion of the sheets is positioned by the standing surface.

According to one or more embodiments of the invention, the sheet detecting sensor has an abutment surface which is parallel to the standing surface of the engaging portion. A plurality of sawtooth portions, each extending in a right-and-left direction, are formed on the abutment surface, and a cut groove opening is formed at a center portion in the right-and-left direction of the abutment surface.

According to one or more embodiments of the invention, the movable stage is slidable in an insertion direction of the sheets.

According to one or more embodiments of the invention, a surface of the movable stage is on the same plane as a surface of the clinch member.

According to one or more embodiments of the invention, the stapler farther includes a cover which covers a rear half portion of the binding table and a moving end of the movable stage is determined by an engagement of the movable stage with the cover.

According to one or more embodiments of the invention, the sheets are placed on the movable stage, then inserted between the clinch member and the staple striking unit and pushed in until the end portion of the sheets engage with the engaging portion. As a result, since the papers are positioned, it is not necessary to separately provide a positioning member.

Since the sheets remain being placed on the upper surface of the movable stage both in the case of binding the sheets at a position away from the end portion of the sheets and in the case of binding the sheets at a position close to the end portion of the sheets, a range of the movable stage on which the sheets are supported does not change. Accordingly, stable binding operation can be always attained. Further, since the binding position on the sheets can be kept constant by the engaging portions, the binding positions are made uniform and so the binding of the sheets can be improved.

According to one or more embodiments of the invention, the relative position between the movable stage and the binding position detection sensor is always the same, and the size of the movable stage does not change depending on the binding position. Thus, stable binding operation can be always attained.

According to one or more embodiments of the invention, when movable stages of various sizes and a dedicated stage for binding only the corner portion may be prepared. In such a case, an unsuitable stage can be detached and a preferable stage can be attached. That is, since the stapler an cope with the various sizes of sheets and the corner binding etc., the movable stage meeting user's needs can be provided.

According to one or more embodiments of the invention, the sheet detecting sensor detects the end portion of the sheets before the end portion (a tip end portion) of the inserted sheets is positioned with respect to the engaging portion of the movable stage which is slidably moved to set the depth for the binding position of the sheets. Thus, the suitable position setting of the sensor with respect to the engaging portions can be performed in view of the time difference from the detection to the binding. Accordingly, in the binding driving based on the detection in accordance with the position setting, the binding driving can be performed immediately after the end portion of the sheets is positioned at the engaging portions. As a result, the influence of the deviation of the binding position caused by the difference of the inserting speed of the sheets can be suppressed to the minimum, whereby the binding operation of the sheets at a desired position can be performed with a high accuracy.

According to one or more embodiments of the invention, the automatic binding can be easily switched to the manual binding by moving the sheet detecting sensor in the rearward direction with respect to the standing engaging portions for positioning the end portion of the sheets to be inserted on the rear portion of the movable stage. Thus, such a troublesome process of detaching the sheet detecting sensor can be eliminated at the time of switching from the automatic operation to the manual operation.

According to one or more embodiments of the invention, the end portion of sheets is detected by the sheet detecting sensor which is positioned on the inner side of the recess portion formed on the rear portion of the movable stage. Thus, almost the center portion in the right-and-left direction (the width direction) of the end portion of the sheets to be inserted is detected. That is, since the end portion of the sheets can be detected more accurately, the binding operation of papers at the desired position can be realized without being deviated.

According to one or more embodiments of the invention, a plurality of the sawtooth portions, each extending in the right-and-left direction (the width direction) is formed on the abutment surface, i.e., on the detection portion parallel to the standing surface of the engaging portion of the sheet detecting sensor, whereby the end portion of the sheets can be surely caught by the sawtooth portions. Thus, the slipping movement of the end portion of the sheets to be inserted on the abutment surface can be effectively prevented, whereby the detection accuracy of the end portion of the sheets to be inserted can be further improved and so the binding operation of papers can be made without the positional deviation.

According to one or more embodiments of the invention, the cut groove opening is formed at the center portion in the right-and-left direction of the abutment surface which is the detection portion parallel to the standing surface of the engaging portion. Thus, the corner of the stack of sheets to be inserted can be stably supported by the cut groove opening, whereby the binding operation at the corner of papers can be performed easily and accurately.

EXPLANATION OF REFERENCE NUMERALS

100 sheets
1 binding table
2*a* clinch groove
8 movable stage
10 engaging portion
20 sheet detecting sensor

BEST MODE FOR CARRYING OUT THE INVENTION

First Embodiment

Figure 1A:
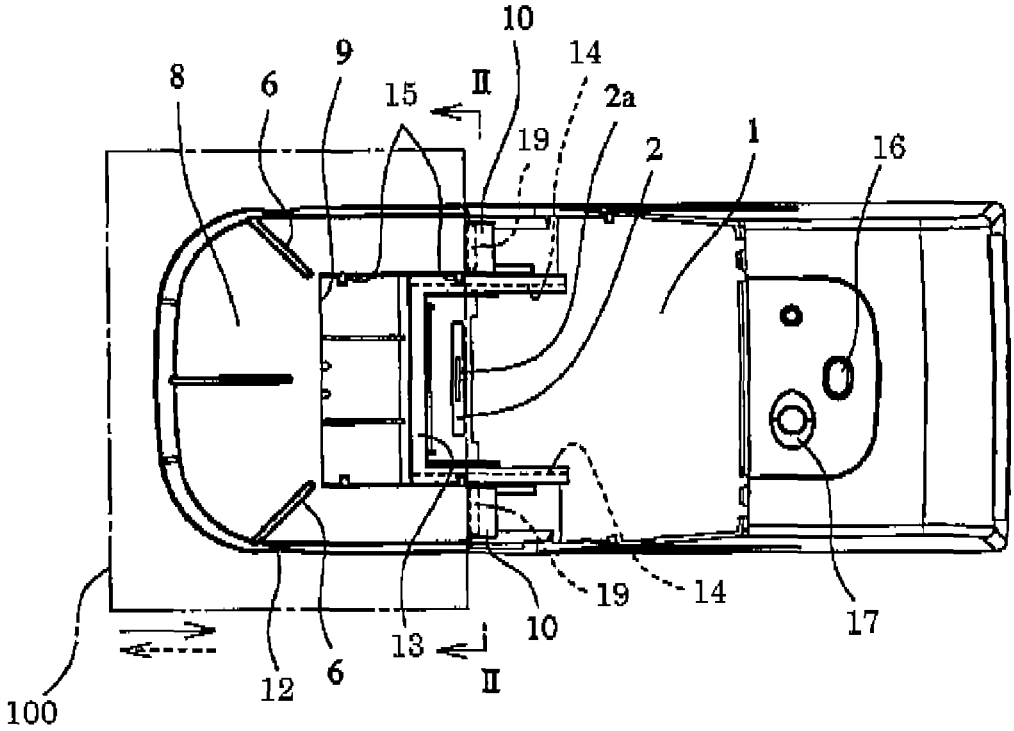
FIG. 1A is a plan view of an electric stapler according to a first embodiment of the present invention, in which a striking mechanism portion is not shown.
Figure 1B:
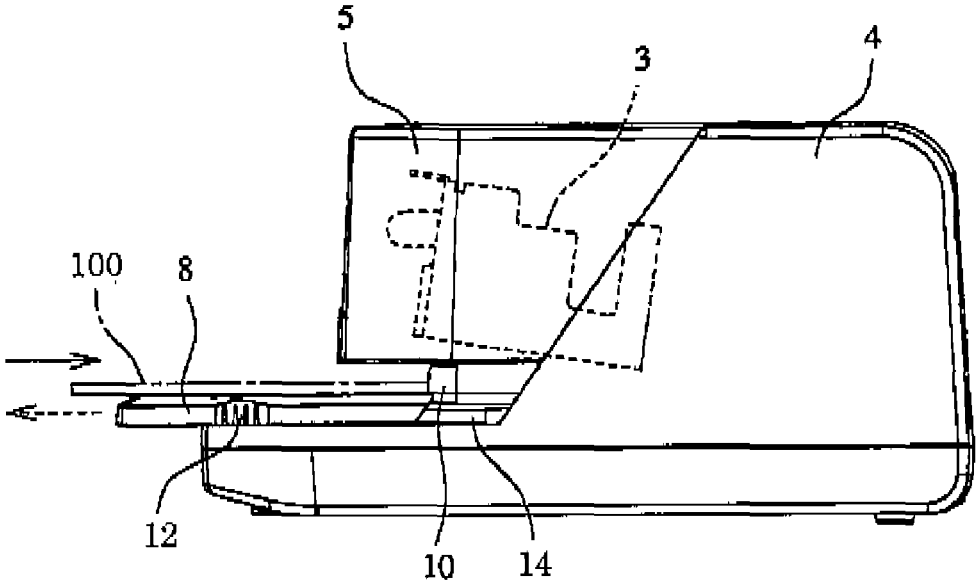
FIG. 1B is a side view of the electric stapler of the first embodiment.

As shown in FIGS. 1A and 1B, the electric stapler according to a first embodiment includes a binding table 1 provided with a clinch member 2 and a striking unit 3 having a staple striking mechanism provided above the binding table 1. A stack of sheets 100 is bound after being inserted between the clinch member 2 and the staple striking unit 3. An upper portion of a rear half of the binding table 1 and the striking unit 3 are covered by covers 4, 5.

The staple striking unit 3 has the staple striking mechanism which drives a driver plate for striking a staple. The striking mechanism is actuated by an electric motor, and downwardly strikes out the foremost staple inside the striking unit 3. The staple thus stuck out penetrates the sheets 100, then abuts against a clinch groove 2*a* of the clinch member 2 and is bent, thereby binding the sheets 100.

A movable stage 8 is provided on a front half of the binding table 1. The movable stage 8 is a member for placing the sheets 100 thereon, and three sides thereof have a shape that conform with an exterior of the binding table 1. A recess portion 9 is formed on an inner side portion of the movable stage 8, and the clinch member 2 having the clinch groove 2*a* on the binding table 1 is disposed on an inner side of the recess portion 9. A surface of the movable stage 8 is set to about the same height (i.e., to be substantially on the same plane) as a surface of the clinch member 2. Engaging portions 10 for positioning a side end portion of the placed stack of sheets 100 are upwardly formed on upper surfaces at respective sides of a rear end portion of the movable stage 8, and concave surface portions 12 are formed on respective sides of a front portion of the movable stage 8 such that fingers can be fitted thereto. Further, guide grooves 6 for corner binding are formed on the movable stage 8.

Figure 2:
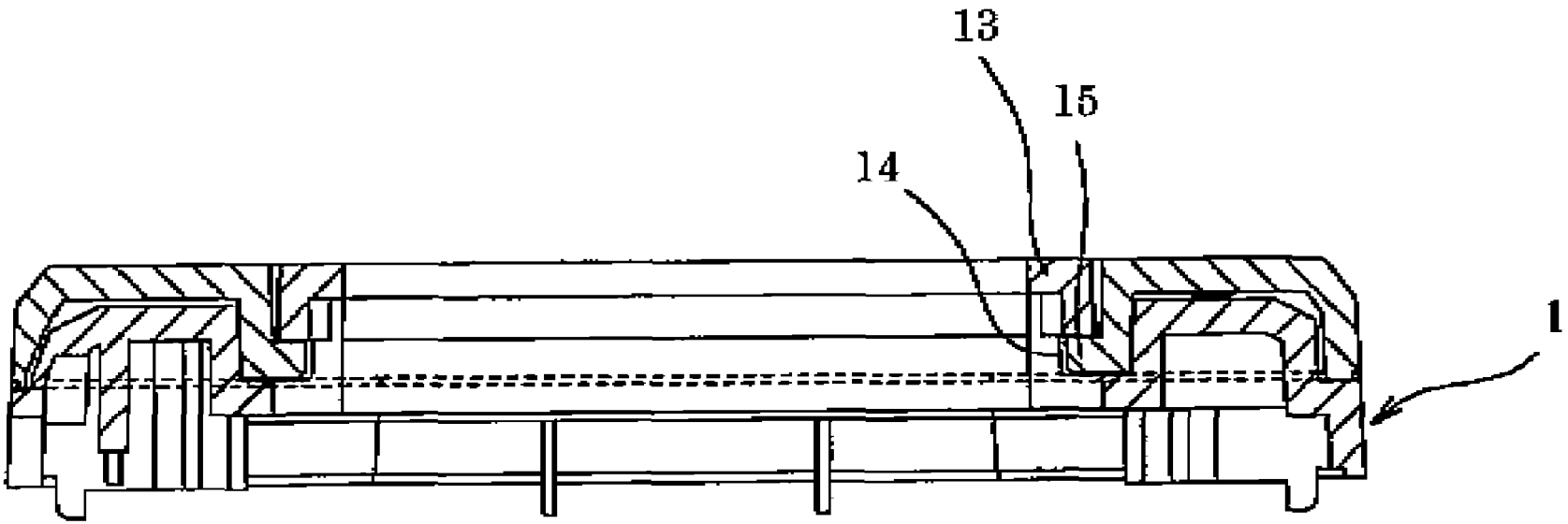
FIG. 2 is a sectional view taken along line II-II in FIG. 1A.

The movable stage 8 is provided so as to be slidable with respect to the binding table 1 in a direction in which the sheets 100 are inserted or drawn out (in a front-and-rear direction). More specifically as shown in FIGS. 1A and 2, an upper surface of the front half of the binding table 1 is formed to be lower by the thickness of the movable stage 8 except for a C-shaped portion 13 around the clinch groove 2*a*. Guide grooves 14 are formed on outer surfaces of the C-shaped portion 13 on respective sides thereof. A pair of projection portions 15, each engaging with the corresponding one of the guide grooves 14, is formed on inner surfaces of respective sides of the recess portion 9 of the movable stage 8 to be fitted to the C-shaped portion 13. According to this configuration, the movable stage 8 is horizontally slidable with respect to the binding table 1. It is preferable that the sliding operation be made a little tight. Alternatively, the sliding operation may be made smooth but can be braked at a certain position by a suitable braking means.

The rear end portions on respective sides of the movable stage 8 engage with a front end surface of a lower portion of the cover 4 of the binding table 1, whereby a moving end in the rearward direction is determined. A moving end in a forward direction of the movable stage 8 may be restricted by providing a stopper (not shown) on the binding table 1. Alternatively, the movable stage 8 may be configured to be able to be detached from the binding table 1 without restricting the moving end in the forward direction. Nevertheless, even in a case of providing the stopper, the stopper is arranged to be operable from the outside so that the movable stage 8 can be detached from the binding table 1. That is, the movable stage 8 is made detachable with respect to the binding table 1.

A selecting switch 16 for selecting between an automatic operation and a manual operation and a manual switch 17 for the manual binding are provided on an upper portion of the cover 5.

Figure 3A:
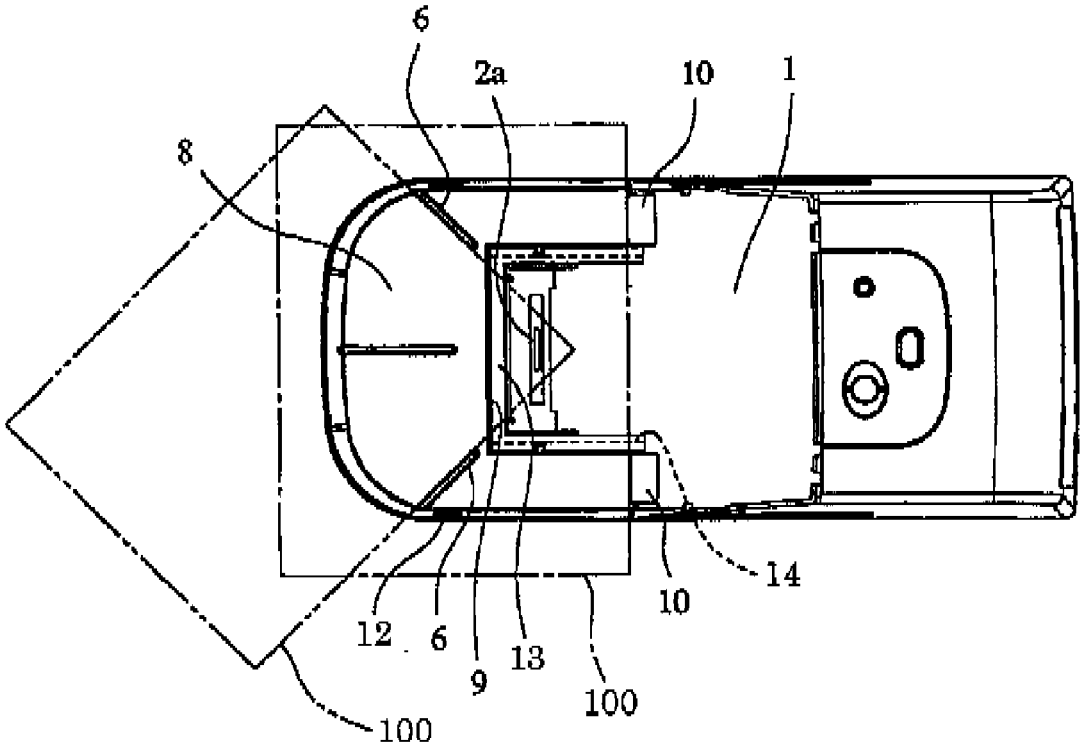
FIG. 3A is a plan view of the electric stapler of the first embodiment showing a movable stage and a stack of sheets in a case where a binding position is separated from a side end portion of the stack of sheets and in a case where a binding position is set at a corner portion of the stack of sheets.
Figure 3B:
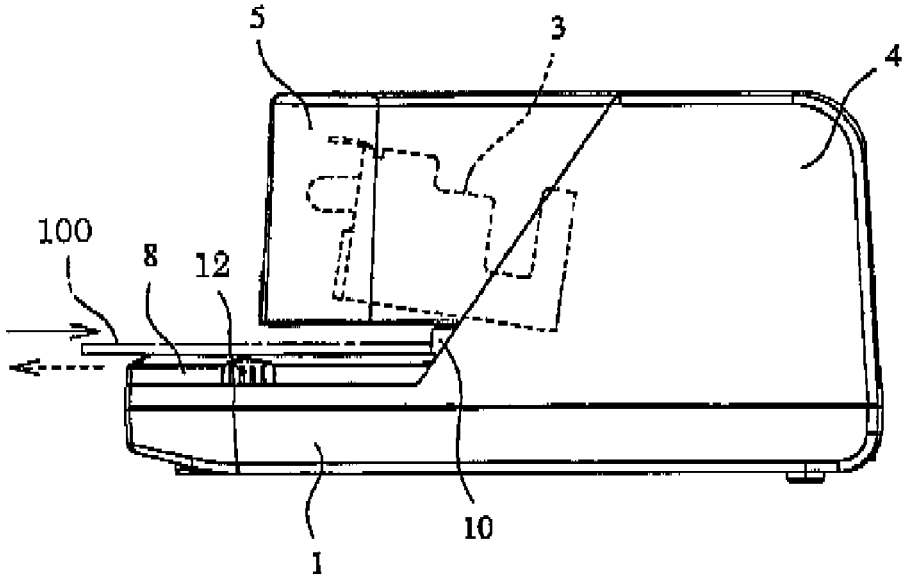
FIG. 3B is a side view of the electric stapler of the first embodiment showing the movable stage and the stack of sheets in the case where the binding position is separated from the side end portion of the stack of sheets.

According to the configuration described above, when binding the sheets 100, firstly, the movable stage 8 is slid in the front-and-rear direction to adjust the position of the engaging portions 10 with the fingers on the concave surface portions 12 at the respective sides of the movable stage 8, thereby determining the binding position on the sheets 100. When binding the sheets 100 at a position close to the side end portion thereof, the movable stage 8 is moved slightly in the rearward direction as shown in FIGS. 1A and 1B. Then, the sheets 100 are placed on the movable stage 8, and are inserted between the clinch groove 2*a* and the striking unit 3 until the side end portion of the stack of sheets 100 engage with the engaging portions 10. In this way, the sheets 100 are positioned. When the manual switch 17 is turned on, the striking unit 3 is actuated to bind the sheets 100 at a certain position. In contrast when binding the sheets 100 at a position away from the side end portion thereon, the movable stage 8 is deeply moved as shown in FIGS. 3A and 3B. After engaging the side end portion of the stack of sheets 100 with the engaging portions 10, the striking mechanism is driven to bind the sheets 100.

When binding the corner portion of the stack of sheets 100, adjacent sides of the stack of sheets 100 are aligned to the guide grooves 6 respectively, and then the sheets 100 are bound.

As described above, the sheets 100 remain placed on the upper surface of the movable stage 8 both in the case of binding the sheets 100 at a position away from the side end portion thereof and in the case of binding the sheets 100 at a position close to the side end portion thereof. Thus, a range of the movable stage 8 on which the sheets 100 are supported does not change. Accordingly, a stable binding operation can be always attained. Further, since the binding position on the sheets 100 is kept constant by the engaging portions 10, the finishing can be improved with uniform binding positions.

Figure 4:
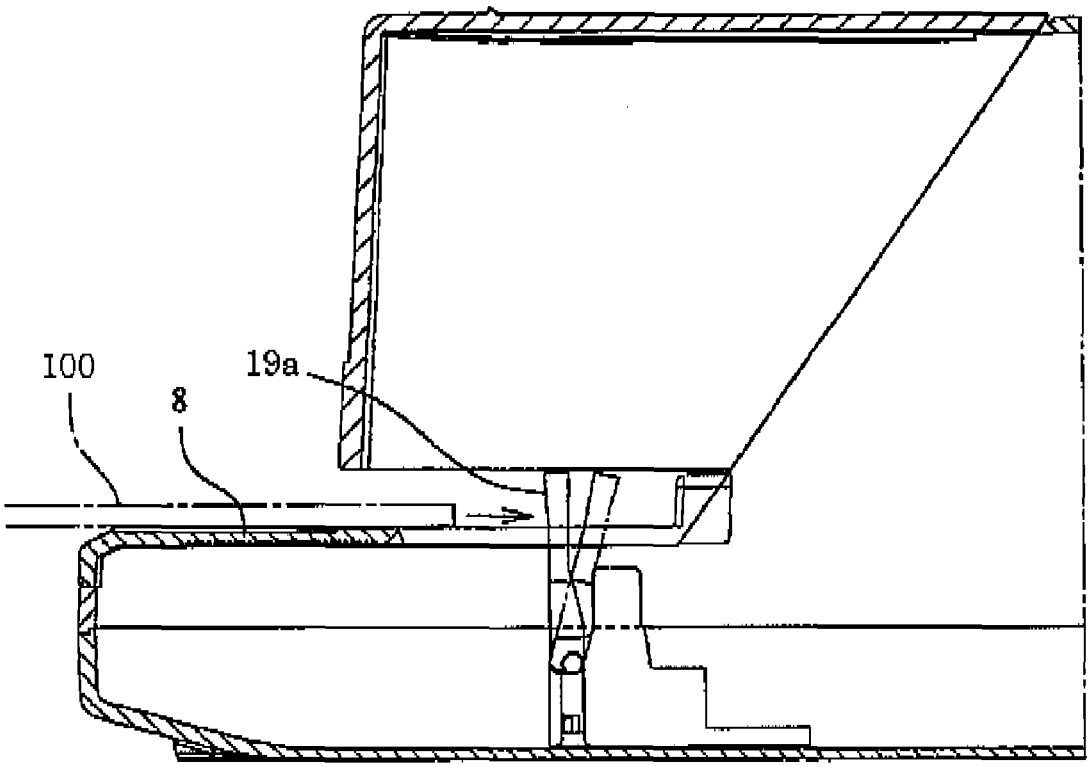
FIG. 4 is a sectional view of a portion of the electric stapler showing a sensor arm.

In a case of automatic binding, a sensor arm 19*a* for detecting the end position of sheets 100 is upwardly set on a rear side of the clinch groove 2*a* as shown in FIG. 4, so that a switch is turned on when the sensor arm 19*a* is pushed by the sheets 100. The sheet detecting sensor may be interlocked with the movable stage 8. For example, the sheet detecting sensors 19 may be respectively disposed at the engaging portions 10 of the movable stage 8 as shown in FIG. 1A, or on a line coupling the respective engaging portions 10. In this case, the striking mechanism is actuated to perform the binding operation in response to a detection of the side end portion of the sheets 100 abutting against the engaging portions 10. The relative position between the movable stage 8 and the sheet detecting sensors 19 are always the same, a range of the movable stage 8 does not change depending on the binding position. Thus, the stable binding can be always obtained.

Figure 5:
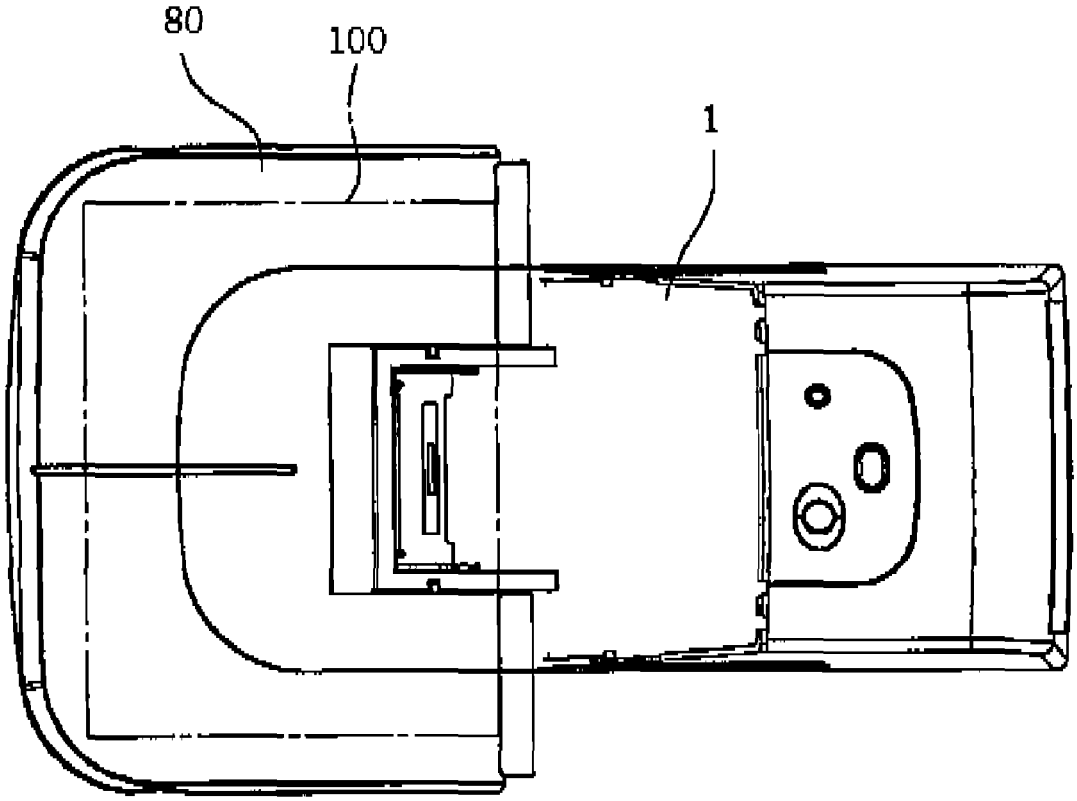
FIG. 5 is a plan view of the electric stapler in which the movable stage is replaced with a large-sized movable stage.

Further, a large-size movable stage 80 shown in FIG. 5 or a dedicated stage for corner bindings (a stage having upwardly protrusion at portions where the guide grooves 6 are formed so as to be engageable with the sheets) may be prepared, thereby detaching an unsuitable stage and attaching a suitable stage. That is, in this case, the stapler can cope with various sizes of sheets and the corner bindings, etc.

Second Embodiment

Figure 6A:
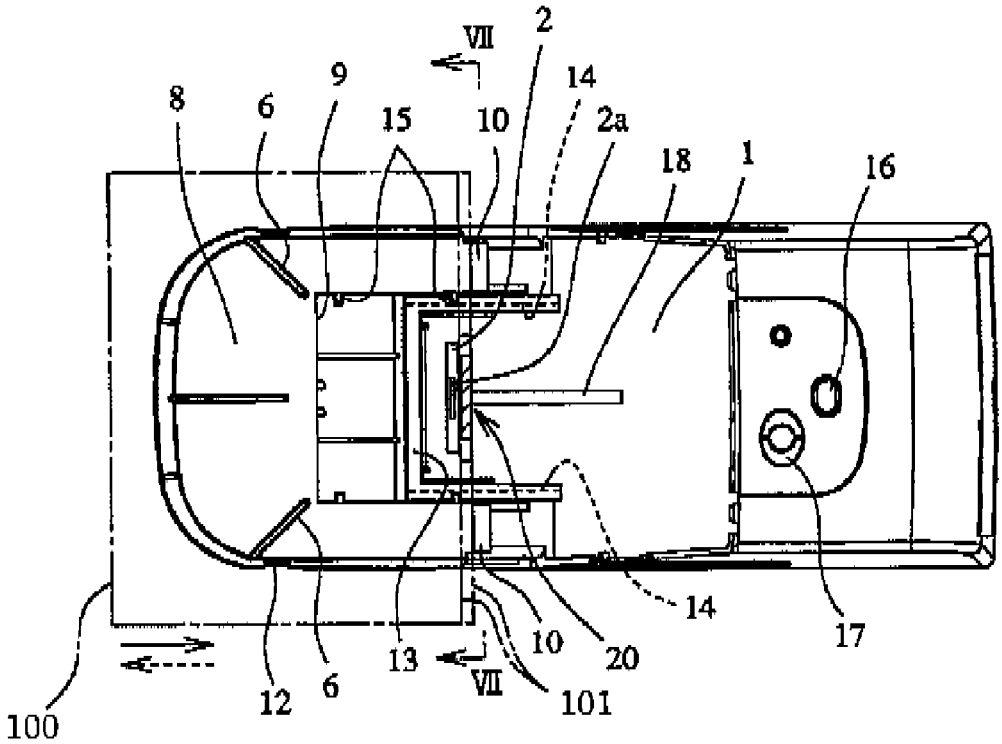
FIG. 6A is a plan view of an electric stapler according to a second embodiment of the present invention, in which a striking mechanism portion is not shown.
Figure 6B:
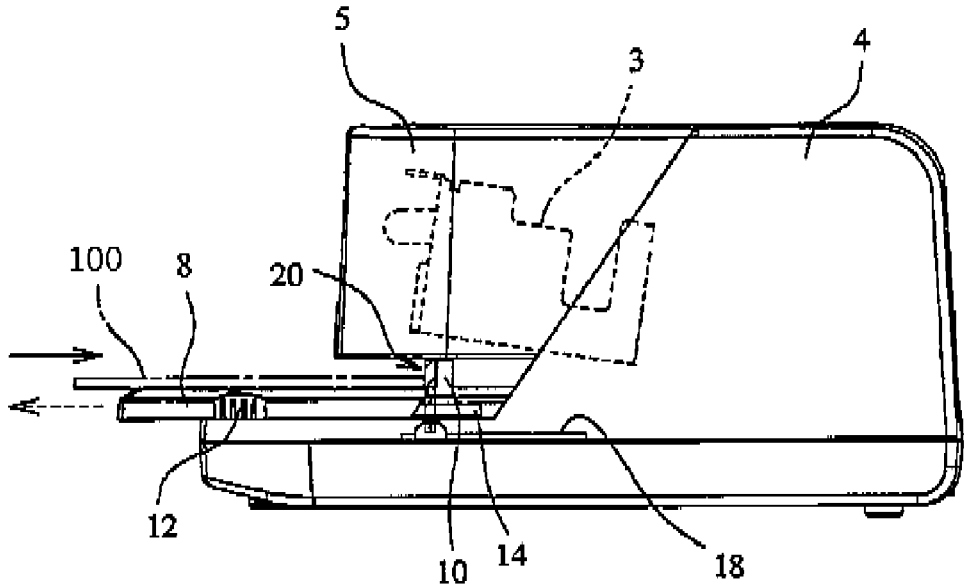
FIG. 6B is a side view of the electric stapler of the second embodiment.
Figure 7:
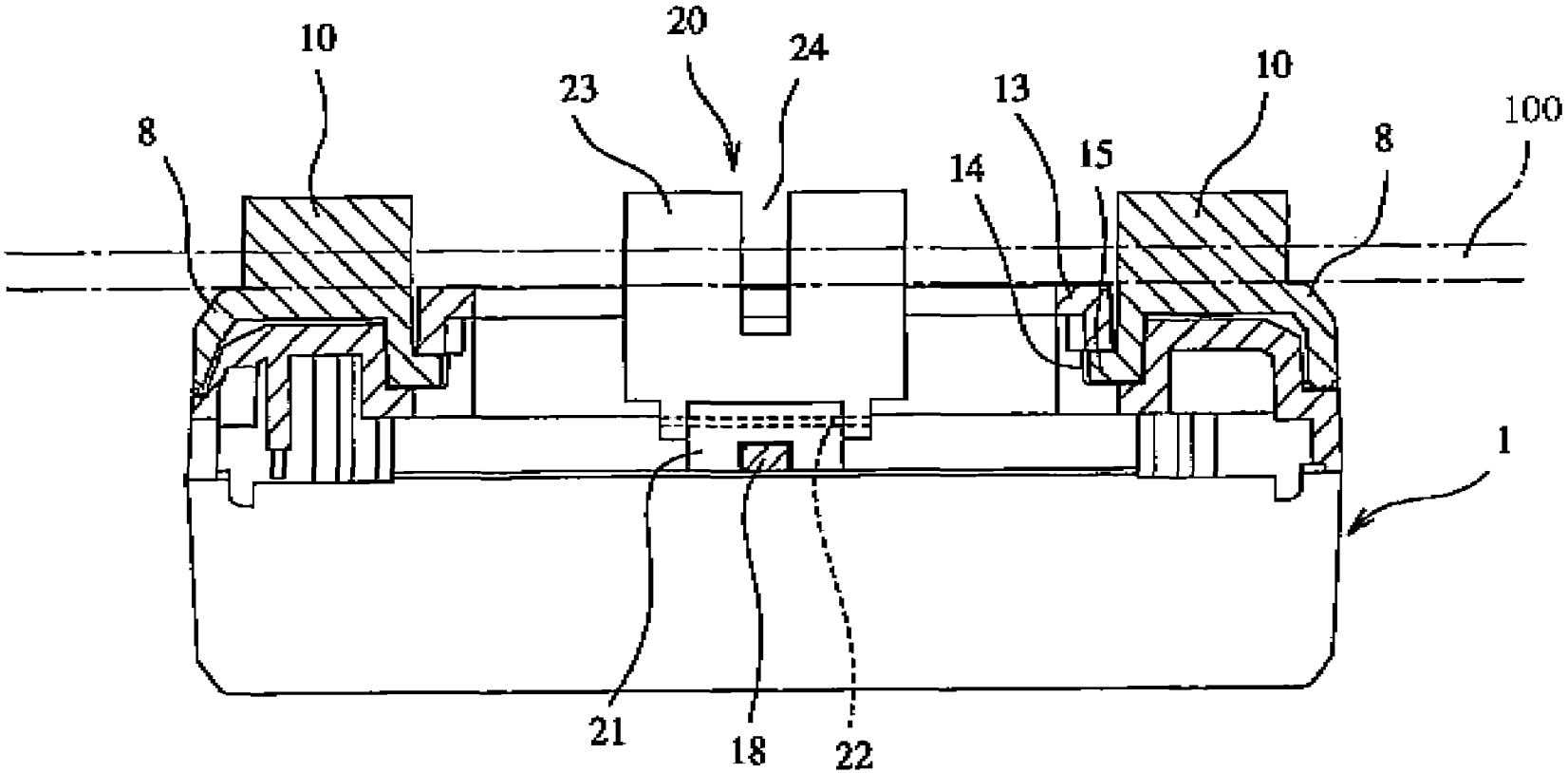
FIG. 7 is a sectional view taken along line VII-VII in FIG. 6A.

FIG. 6A is a plan view of an electric stapler according to a second embodiment and FIG. 6B is a side view of FIG. 6A. FIG. 7 is a sectional view taken along the line VII-VII in FIG. 6. In the second embodiment, portions identical to those of the first embodiment are indicated with the same reference numerals, and explanation thereof will be omitted.

The electric stapler of the second embodiment has a sheet detecting sensor 20 provided so as to oppose to the recess portion 9 formed at the rear portion of the movable stage 8.

The sheet detecting sensor 20 is guided by a guide rail 18, which is provided on the binding table 1 on a rear side of the clinch member 2 having the clinch groove 2*a* and is extended in the front-and-rear direction in a certain length, and is slidable in the direction in which the sheets are inserted or drawn out (the front-and-rear direction) so as to be able to enter or move out from the recess portion 9.

Figure 11A:
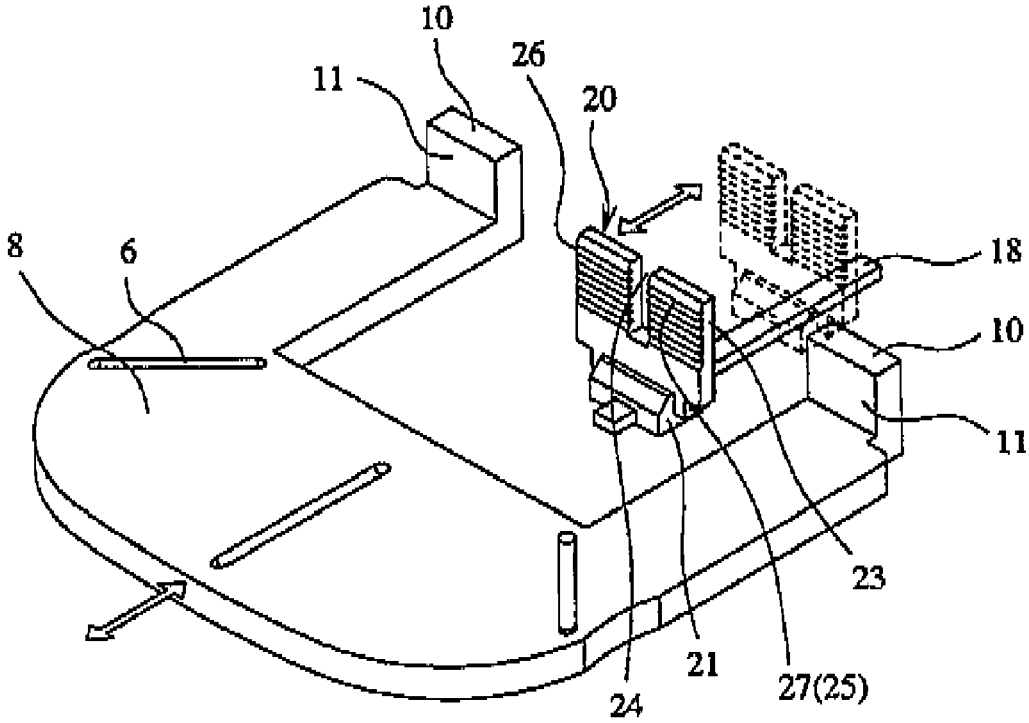
FIG. 11A is an explanatory view showing an external perspective structure of the movable stage and a sheet detecting sensor and a relative movement and positional relation between the movable stage and the sheet detecting sensor.
Figure 11B:
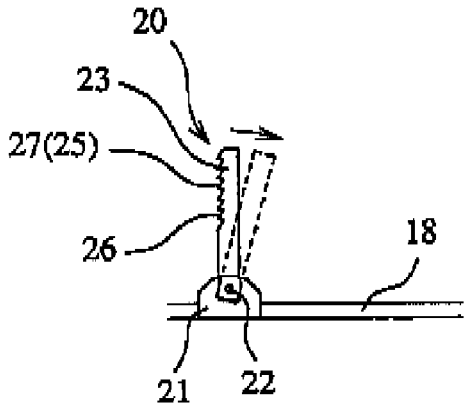
FIG. 11B is a sectional view of the sheet detecting sensor shown in FIG. 11A.

As shown in FIGS. 11A and 11B, the sheet detecting sensor 20 includes a lower base 21 and a plate member 23 having a certain thickness and attached to the base 21 via a supporting shaft 22. The lower base 21 is supported so as to be movable along the guide rail 18 and to be optionally fixed at certain positions. The plate member 23 is rearwardly tiltable with respect to the lower base 21 via the supporting shaft 22 within a certain angle range upon receipt of a stain force. Further, when the force is removed, the plate member 23 is returned to its initial position due to an action of a not-shown return spring. An action force of the return spring is set to be relatively small so as not to affect the insertion of the sheets or the positioned sheets. The plate member 23 is suitably provided with a not-shown tilt lock means. When the plate member 23 is tilted, a not-shown detection switch is turned onto drive the staple striking unit 3.

An upper portion of the plate member 23 is forked into two with a cut groove opening 24 therebetween at the center in the right-and-left width direction (a width direction) thereof. An abutment surface 27 serving as the detection portion of the sheet detecting sensor 20 is formed on a plate surface 25 on a front side of the plate member 23. Linear sawtooth portions 26 are formed on the plate surface 25, extending in the right-and-left direction (the width direction) parallel to each other. The sawtooth portions 26 function as a stopper for the side end portion 101 of the stack of sheets 100, and are configured to have sawteeth shapes which are downwardly directed non-returning shapes as shown in FIGS. 11A and 11B.

Figure 8:
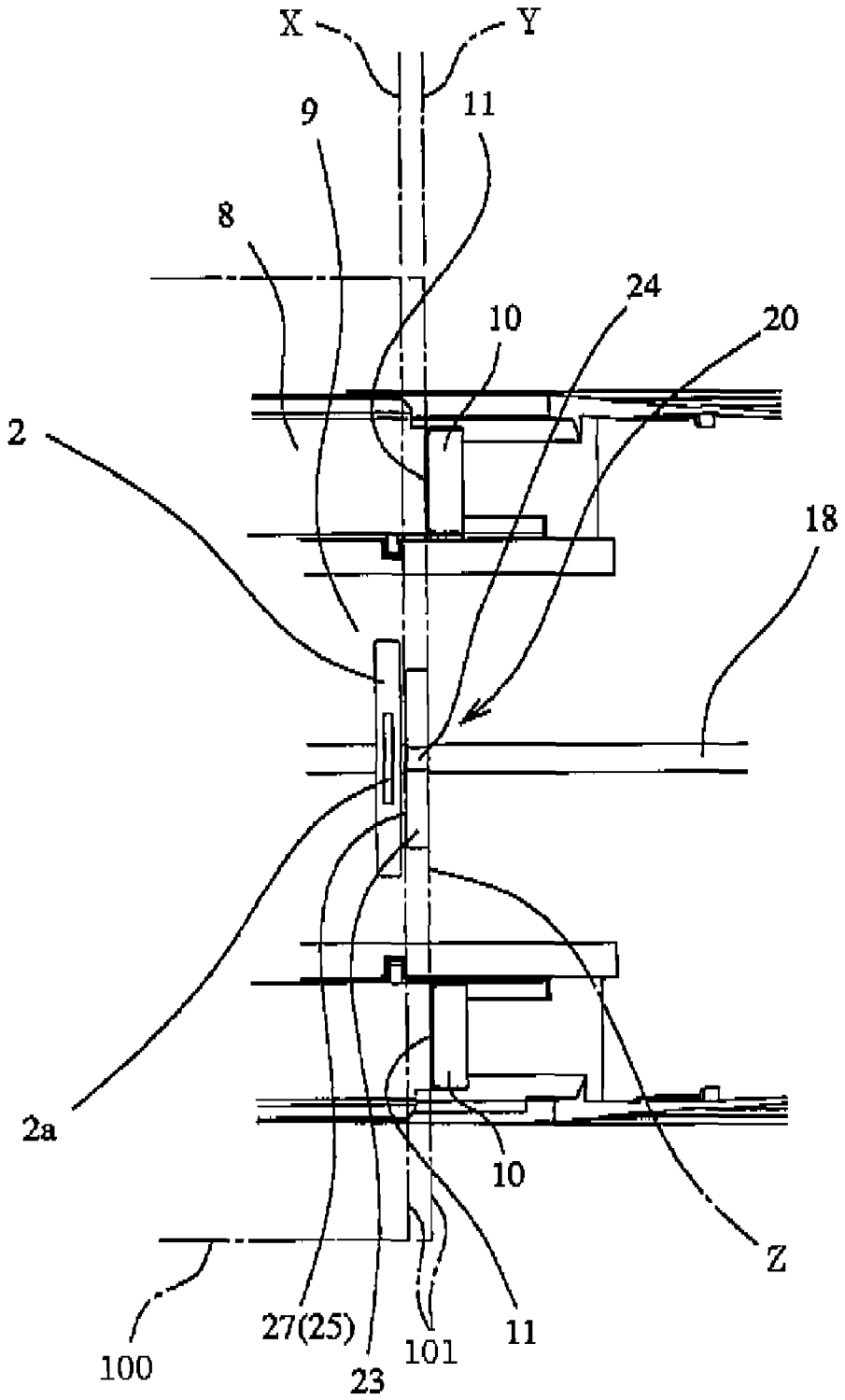
FIG. 8 is an enlarged view of a portion of the electric stapler shown in FIG. 6A.
Figure 10:
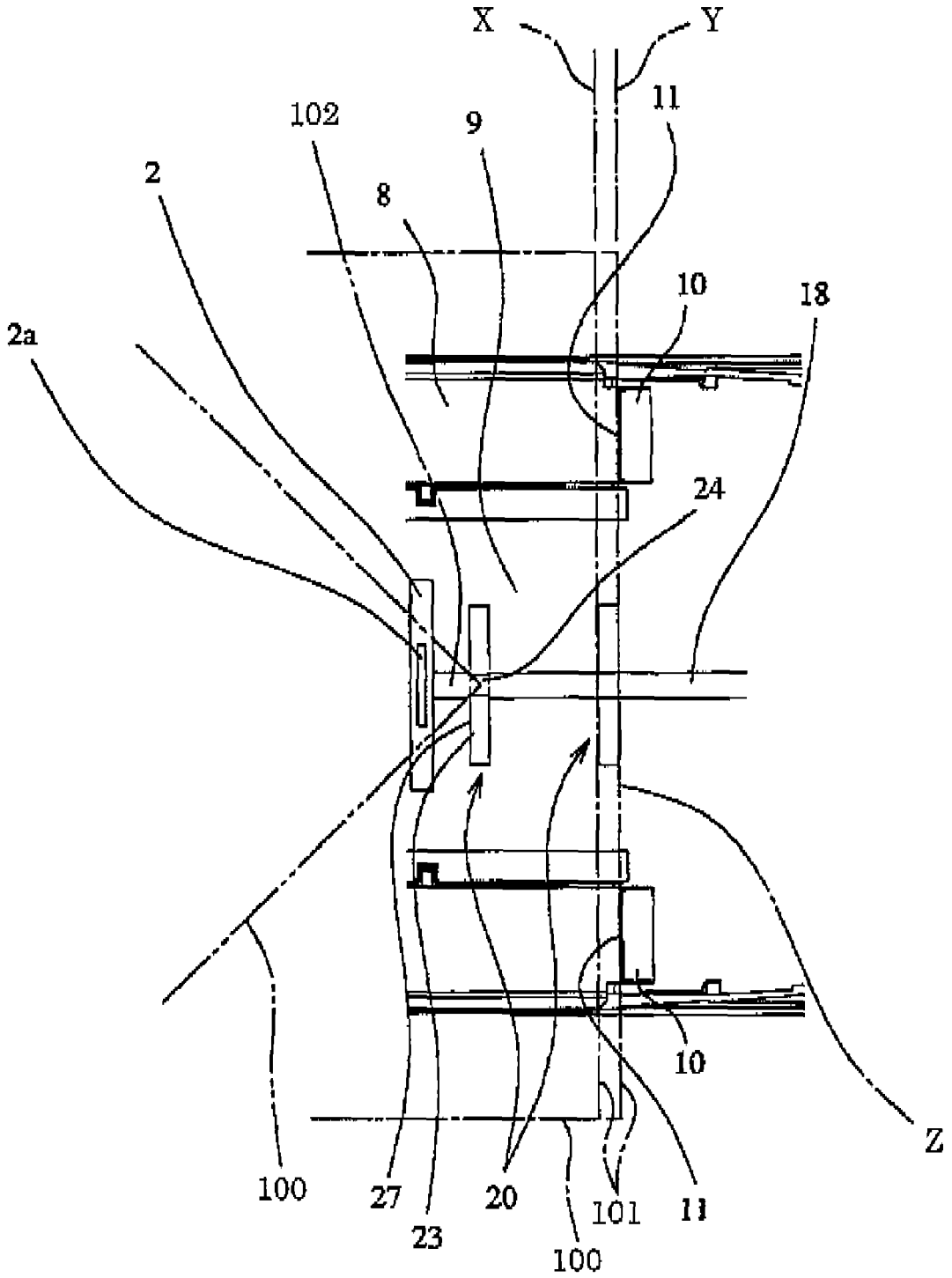
FIG. 10 is an enlarged view of a portion of the electric stapler shown in FIG. 9A.

Upon detecting the position of the sheets 100, the sheet detecting sensor 20 is positioned such that the abutment surface 27 for detecting the side end portion 101 on the insertion front side of the sheets 100 becomes slightly on a front side of a line Z coupling the standing surfaces 11 of the pair of the engaging portions 10 of the movable stage 8 (see a line X in each of FIGS. 8 and 10). The guide rail 18 has an extending structure which allows the movable range of the sheet detecting sensor 20 such that the abutment surface 27 can be positioned in a case of binding the sheets 100 at a position close to the side end portion 101 thereof, i.e., a case of moving the movable stage 8 slightly in the rearward direction and also in a case of binding a position away from the side end portion 101 of the stack of sheets 100.

That is the guide rail 18 has the extending structure which enables the sheet detecting sensor 20 to move such that the abutment surface 27 of the sheet detecting sensor 20 can be located slightly on the front side of the position of the standing surfaces 11 of the engaging portions 10 of the movable stage 8 when slightly moving the movable stage 8 in the rearward direction, and such that the abutment surface 27 of the sheet detecting sensor 20 can be located slightly on the front side of the position of the standing surfaces 11 of the engaging portions 10 of the movable stage 8 when largely moving the movable stage 8 in the rearward direction.

According to the configuration described above, when automatically binding the sheets 100, firstly, fingers are placed at the concave surface portions 12 on the respective sides of the movable stage 8 (see FIG. 6B) to slide the movable stage 8 in the front-and-rear direction to adjust the position of the engaging portions 10, thereby determining the binding position on the sheets 100.

When binding the sheets 100 at a position close to the side end portion thereof, as shown in FIGS. 6A and 6B and FIG. 8 which is a partially enlarged view of FIG. 6A, the movable stage 8 is moved slightly in the rearward direction.

Next, the sheet detecting sensor 20 is moved in the forward direction such that the sheet detecting sensor 20 is positioned and fixed so that the detection portion of the sheet detecting sensor 20, that is, one of the plate surfaces 25 which is the abutment surface 27 is located slightly on the front side (see the line X in FIG. 8) of the standing surfaces 11 of the engaging portions 10 of the movable stage 8. Thereafter, the sheets 100 are placed on the movable stage 8, then inserted between the clinch groove 2*a* and the striking unit 3 until the side end portion 101 of the stack of the sheets 100 engage with the engaging portions 10 (see a line Y in FIG. 8).

Then, in the insertion process of the sheets 100, the side end portion 101 of the sheets 100 abut against the abutment surface 27 of the sheet detecting sensor 20 positioned on the slightly front side of the standing surfaces 11 of the engaging portions 10 and so the side end portion 101 of the sheets 100 are caught by the downwardly directed saw-tooth portions 26 having the non-returning shape of the abutment surface 27, whereby the plate member 23 is pushed and is tilted to turn the not-shown switch on. Thereafter, the side end portion 101 of the sheets 100 abut against the standing surfaces 11 of the engaging portions 10 of the movable stage 8 so that the sheets 100 are positioned, whereby almost simultaneously the striking unit 3 is operated to bind a certain position close to the side end portion of the stack of sheets 100.

Figure 9A:
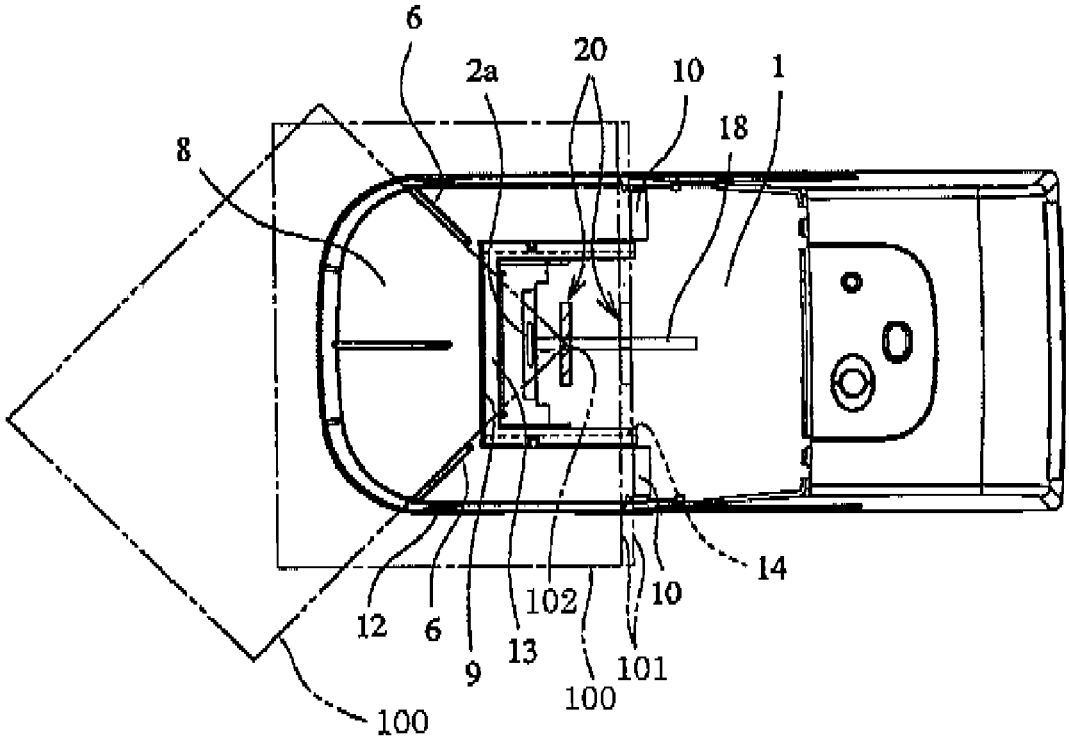
FIG. 9A is a plan view of the electric stapler of the second embodiment showing a movable stage and a stack of sheets in a case where a binding position is separated from a side end portion of the stack of sheets and in a case where a binding position is set at a corner portion of the stack of sheets.
Figure 9B:
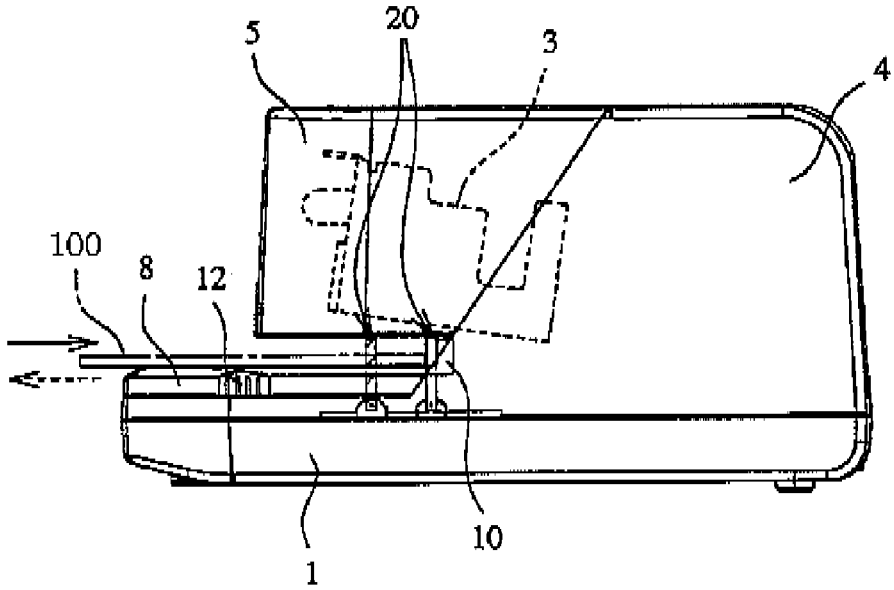
FIG. 9B is a side view of the electric stapler of the second embodiment showing the movable stage and the stack of sheets in the case where the binding position is separated from the side end portion of the stack of sheets and in the case where the binding position is set at the corner portion of the stack of sheets.

When binding the sheets 100 at a position away from the side end portion 101 thereof as shown by a dashed-dotted line in FIG. 9A, the movable stage 8 is deeply moved as shown in FIGS. 9A and 9B and FIG. 10 which is a partially enlarged view of FIG. 9A.

Next, the sheet detecting sensor 20 is moved so that the detection portion of the sheet detecting sensor 20, that is, the abutment surface 27 is positioned at a position slightly on the front side of the standing surfaces 11 of the engaging portions 10 of the movable stage 8 (see the line X in FIG. 10). Then, the sheets 100 are placed on the movable stage 8 and are pushed in until abutting against the engaging portions 10 (see the line Y in FIG. 10), whereby the sheets 100 are bound at the position away from the side end portion 101 thereof by the staple striking unit 3 via the process similar to that in the case of binding the position close to the side end portion 101 of the sheets 100.

In contrast when manually binding the sheets 100, in either of the case of binding the sheets 100 at a position close to the side end portion 101 thereof and the case of binding the sheets 100 at a deeper position from the side end portion 101 thereof, the sheet detecting sensor 20 for the sheets 100 is moved rearward from the standing surfaces 11 of the engaging portions 10 of the movable stage 8, that is, from the line Y coupling the standing surfaces 11. Then, the side end portion 101 of the stack of sheets 100 abut against the standing surfaces 11 of the engaging portions 10 to confirm the positioning of the sheets 100. Then, when the manual switch 17 is turned on, the staple striking unit 3 is actuated to bind the sheets 100 at a certain position.

For example, in the second embodiment the sheet detecting sensor 20 being movable in the front-and-rear direction at the center portion in the width direction of the stapler cannot be located in front of the clinch member 2 opposing beneath the driver plate. Thus, by the simple switching to the manual operation, a stapling at a position quite close to the side end portion 101 of the stack of sheets 100 can be performed, whereby the efficiency of the binding operation of the sheets 100 can be improved.

Further, as shown by a two-dot chain line in each of FIG. 9A and FIG. 10 which is a partially enlarged view thereof the corner binding of the sheets 100 is performed manually. That is, the adjacent sides of the stack of sheets 100 are aligned along the guide grooves 6, then the tilting of the plate member 23 of the sheet detecting sensor 20 for the sheets 100 is locked, and then the sheet detecting sensor 20 is slid toward the corner 102 of the sheets 100 to thereby abut the corner 102 of the sheets 100 against the cut groove opening 24 of the plate member 23 to bind the sheets.

According to the second embodiment, in each of the case of binding the sheets 100 at a deep position from the side end portion 101 thereof and the case of binding sheets 100 at a position close to the side end portion 101 thereof, the sheets 100 are placed on the upper surface of the wide movable stage 8 and the range of the movable stage 8 supporting the sheets 100 does not change. Thus, the stable binding can always be obtained. Further, since the binding position of the sheets 100 is kept constant by the engaging portions 10, the binding positions can be uniform and so the finishing can be improved.

In the case of the automatic binding of the sheets 100, the abutment surface 27 serving as the detection portion of the sheet detecting sensor 20 is positioned slightly on the font side (see the line X in each of FIGS. 8 and 10) with respect to the standing surfaces 11 of the engaging portions 10 of the movable stage 8. Thus, the side end portion 101 of the stack of sheets 100 abut against the abutment surface 27 and is surely caught by the sawtooth portions 26. Then, the plate member 23 is tilted by the pushing force of the sheets 100 to turn the switch on, whereby almost simultaneously the side end portion 101 of the sheets 100 abut against the standing surfaces 11 of the engaging portions 10. Thus, papers can be bound accurately at the desired position without being influenced by the insert speed of sheets 100.

Since the abutment surface 27 seeing as the detection portion of the sheet detecting sensor 20 is formed as the sawtooth portions 26 having the non-returning shape directed downward, the side end portion 101 of the inserted sheets 100 can be caught further surely, whereby the plate member 23 of the sheet detecting sensor 20 is tilted with the certain inclined angle to turn the switch on. On the other hand, the plate member 23 is arranged in a manner that until the side end portion 101 of the sheets 100 are positioned by the standing surfaces 11 of the engaging portions of the movable stage 8, the sawtooth portions 26 hold the side end portion 101 of the stack of sheets 100 during the tilting of the plate member 23. Thus, the slipping movement of sheets 100 toward the deeper side can be effectively prevented.

Further, since the abutment surface is formed as the sawtooth portions 26 having the non-returning shape directed downward the side end portion 101 of the stack of sheets 100 can be caught more surely without being influenced by the inserting speed of sheets 100. Thus, a deviation of the binding position on the sheets 100 caused from the differences of the inserting speed of sheets 100 is hardly generated.

The automatic binding operation can be easily switched to the manual binding operation by merely positioning the sheet detecting sensor 20 in the rearward side with respect to the standing surfaces 11 of the engaging portions of the movable stage 8. Thus, the stapler with good usability can be provided.

Although the invention is explained in detail and with reference to specific embodiments, it will be apparent for those skilled in the art that various changes and modifications can be made without departing from the spirit and scope of the present invention.

The present application is based on Japanese Patent Application No. 2005-341868 filed on Nov. 28, 2005 and Japanese Patent Application No. 2005-366080 filed on Dec. 20, 2005, the contents of which are incorporated herein by reference.

INDUSTRIAL APPLICABILITY

The stapler, which can always support a stack of sheets over the same range irrespective of a binding position on the sheets, can be provided. The present invention is applicable not only to a stapler for stapling normal papers but also to a stapler for binding blister packs, etc. Thus, in this description, the sheets include not only office papers and documents but also items to be bound by a stapler such as blister packs.

The invention claimed is:

1. A stapler comprising:

a binding table;

a clinch member disposed on the binding table;

a staple striking unit disposed above the binding table;

a movable stage disposed so as to be slidable with respect to the binding table; and a sheet detecting sensor which is provided so as to be slidable with respect to the movable stage, wherein the sheet detecting sensor detects the end portion of the sheets before the end portion of the sheets is positioned by an engaging portion, and the staple striking unit strikes out a staple based on a detection of the end portion of the sheets by the sheet detecting sensor, wherein the movable stage is formed with the engaging portion, the engaging portion positions an end portion of sheets placed on the movable stage, and the sheets are inserted and bound between the clinch member and the staple striking unit, wherein a recess portion is formed on a rear portion of the movable stage and a pair of pieces interpose the recess portion therebetween, each piece of the pair of pieces has an end portion, the engaging portion is formed on each end portion and the engaging portion has a standing surface extending perpendicular to an insertion direction of the sheets, and the sheet detecting sensor is positioned on an inner side of the recess portion and detects the end portion of the sheets before the end portion of the sheets is positioned by the standing surface, and wherein the sheet detecting sensor has an abutment surface which is parallel to the standing surface of the engaging portion, a plurality of sawtooth portions, each extending in a right-and-left direction, are formed on the abutment surface, and a cut groove opening is formed at a center portion in the right-and-left direction of the abutment surface.

2. The stapler according to claim 1, further comprising a sheet detecting sensor which detects a position of the end portion of the sheets, wherein the sheet detecting sensor moves interlockingly with the movable stage.

3. The stapler according to claim 1, wherein the movable stage is attachable and detachable with respect to the binding table.

4. The stapler according to claim 1, wherein the movable stage is slidable in an insertion direction of the sheets.

5. The stapler according to claim 1, wherein a surface of the movable stage is on the same plane as a surface of the clinch member.

6. The stapler according to claim 1, further comprising a cover which covers a rear half portion of the binding table, wherein a moving end of the movable stage is determined by an engagement of the movable stage with the cover.

* * * * *